United States Patent [19]

Carlson

[11] Patent Number: 4,782,770

[45] Date of Patent: Nov. 8, 1988

[54] COMBUSTOR FOR FINE PARTICULATE COAL

[75] Inventor: Larry W. Carlson, Oswego, Ill.

[73] Assignee: The United States of America as represented by the United States Department of Energy, Washington, D.C.

[21] Appl. No.: 148,513

[22] Filed: Jan. 26, 1988

[51] Int. Cl.[4] ..... F23D 1/02

[52] U.S. Cl. ..... 110/264; 110/347; 431/173

[58] Field of Search ..... 110/264, 347; 431/173

[56] References Cited

U.S. PATENT DOCUMENTS

| | | | |
|---|---|---|---|
| 3,727,563 | 4/1973 | Hasselbring et al. . | |
| 3,837,813 | 9/1974 | Ebeling et al. . | |
| 3,855,951 | 12/1974 | Giles . | |
| 4,052,266 | 10/1977 | Griffith | 110/264 X |
| 4,146,359 | 3/1979 | Lumpkin et al. . | |
| 4,159,000 | 6/1979 | Iwasaki et al. . | |
| 4,398,477 | 8/1983 | Iwasaki . | |
| 4,545,306 | 10/1985 | Wolfram . | |
| 4,561,364 | 12/1985 | Green et al. | 110/264 X |
| 4,584,948 | 4/1986 | Syred et al. | 110/264 |
| 4,683,541 | 7/1987 | David | 110/264 X |

OTHER PUBLICATIONS

U.S. Statutory Invention Registration No. H19 to Carlson, published on 2/4/1986.

*Primary Examiner*—Edward G. Favors

*Attorney, Agent, or Firm*—Hugh W. Glenn; Robert J. Fisher; Judson R. Hightower

[57] ABSTRACT

A particulate coal combustor with two combustion chambers is provided. The first combustion chamber is toroidal; air and fuel are injected, mixed, circulated and partially combusted. The air to fuel ratio is controlled to avoid production of soot or nitrogen oxides. The mixture is then moved to a second combustion chamber by injection of additional air where combustion is completed and ash removed. Temperature in the second chamber is controlled by cooling and gas mixing. The clean stream of hot gas is then delivered to a prime mover.

3 Claims, 3 Drawing Sheets

COMBUSTOR FOR FINE PARTICULATE COAL

CONTRACTUAL ORIGIN OF THE INVENTION

The United States of America has rights in this invention pursuant to Contract No. W-31-109-ENG-38 between the United States Department of Energy and the University of Chicago, the operator of Argonne National Laboratory.

BACKGROUND OF THE INVENTION

This inention relates to a combustor for fine particulate coal, a plentiful fuel in the United States. Coal can be used as a fuel to provide a stream of clean, hot gas for a prime mover such as a gas turbine in, for example, a peaking station for generation of electricity or a locomotive. However, because coal is a solid, its use as a fuel creates ash and soot as well as the usual pollutants resulting from combustion. Turbine blades are quite vulnerable to erosion by particulates in the gas stream, and can also be corroded by chemical reactions occurring between matter in the gas stream and the blade metal at the high temperature at which the turbine is operating. These processes together can destroy a turbine blade in a very short time. Thus, it is important that the gas stream be free of particulate matter.

Using finely ground coal allows a combustion process resulting in a clean stream of hot gas. However, while combustion of fine particulate reduces ash, the combustion process can be difficult to control. Combustion must occur in a manner which insures good control of the temperature and the local and overall stoichiometric ratio (the ratio of air to fuel in the mixture) to insure complete combustion, and avoid formation of nitrogen oxide, a pollutant, as well as soot, which is extremely difficult to burn. If the temperature is too high, the formation of nitrogen oxides is encouraged; if it is too low, combustion is incomplete and soot will be formed. A local excess of air per unit of fuel likewise leads to formation of nitrogen oxides; a deficiency results in localized incomplete combustion and production of soot. Of course, both are undesirable since nitrogen oxides pollute the atmosphere, and soot prevents the delivery of clean gas.

SUMMARY OF THE INVENTION

It is an object of the present invention to combust particulate coal and provide a stream of hot gas to a prime mover.

It is another object of the present invention to provide a stream of hot gas which is free of ash, soot, or other particulate matter.

It is another object of the present invention to control the stoichiometric ratio and temperature of combustion to minimize the production of pollutants and soot.

In accordance with the present invention, the combustor is comprised of two concentric truncated cones. At the upper ends of the cones, the annular space between them is sharply expanded to form a torus constituting a primary combustion chamber. The distance between the cones in the annular space below the primary combustion chamber gradually increases toward the lower ends of the cones, and forms a secondary combustion chamber. Air and fuel are introduced to the primary combustion chamber through tangential injectors to induce circular movement of the air-fuel mixture in the primary combustion chamber around the inner cone. Secondary air is introduced through slanted injectors at the top of the ring near the inner cone to induce a circular movement of air in the primary chamber between the inner cone and the fuel-air mixture.

The primary combustion chamber communicates with the secondary chamber. The partially-burned fuel-air mixture and secondary air move to the secondary chamber, where combustion is completed. Because the secondary chamber expands as distance from the primary chamber increases, the gas expands and mixes with secondary air, thereby moderating the combustion temperature. Because the mixture is rotating around the inner cone, molten ash is driven by centrifugal force to the inside surface of the outer cone. The ash flows downwardly by gravity into a hemispherical collector attached to the bottom of the outer cone. Combustion gas reverses its flow direction to travel through the center of the inner cone and exhaust through an exit at the top, from which it travels to the prime mover.

BRIEF DESCRIPTION OF THE DRAWINGS

The present invention is illustrated in the accompanying drawings wherein.

DETAILED DESCRIPTION OF THE INVENTION

Figure 1:
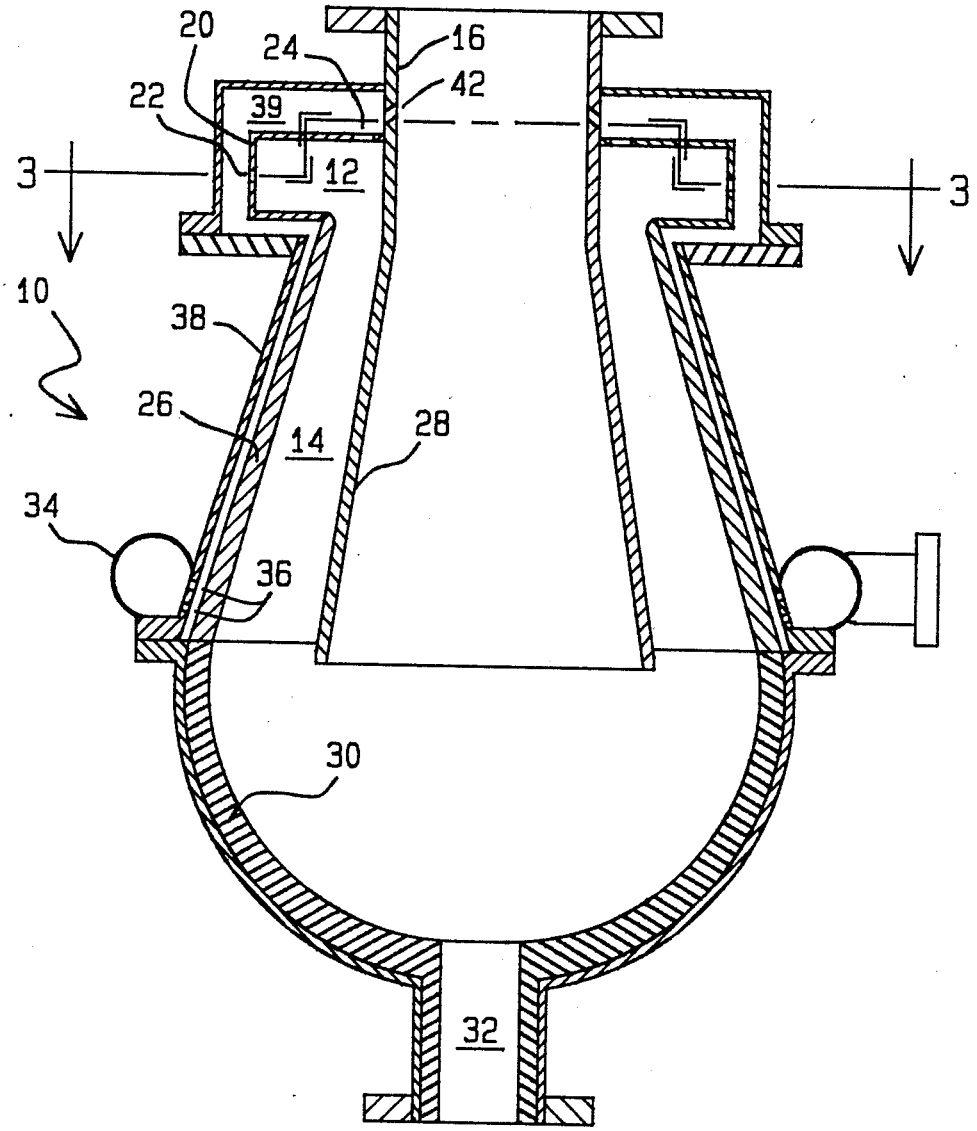
FIG. 1 is a cross-sectional view of a particulate coal combustor.
Figure 3:
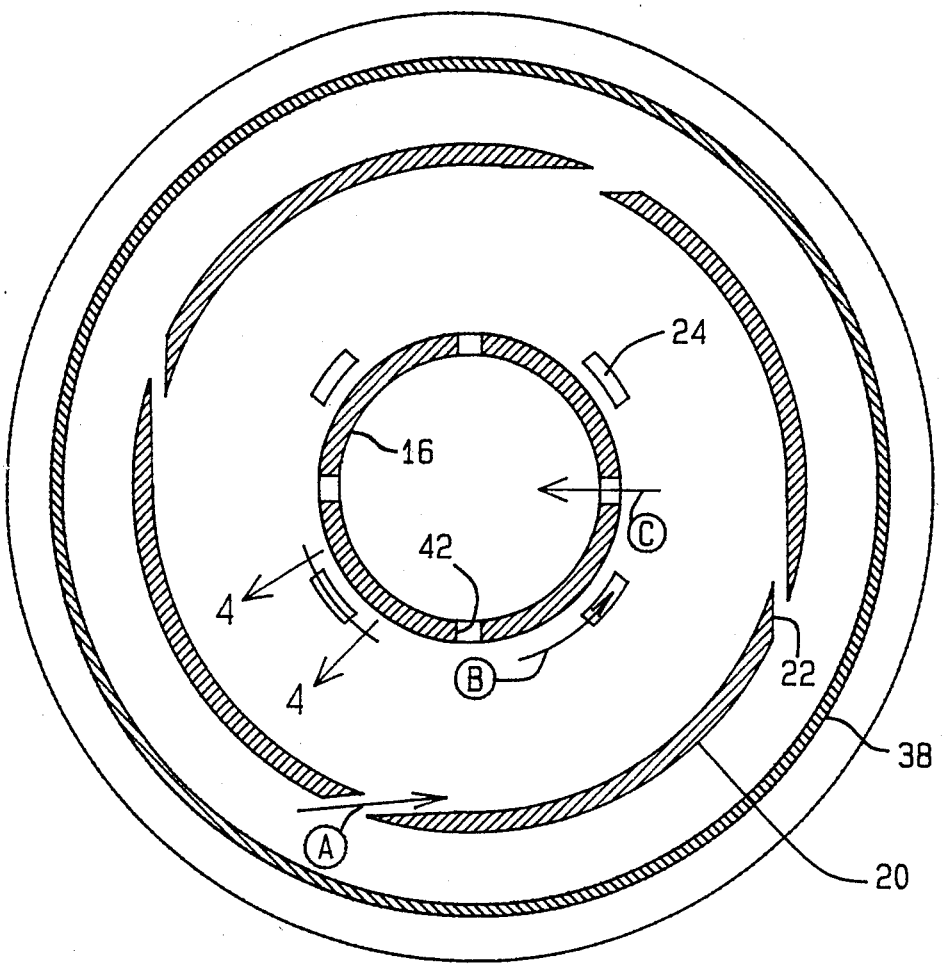
FIG. 3 is a cross-section of the coal combustor along line 3—3 of FIG. 1.

FIG. 1 depicts a particulate coal combustor 10 having a primary combustion chamber 12 and a secondary combustion chamber 14. Primary combustion chamber 12 surrounds combustion gas exhaust trunk 16, through which hot gas passes from combustor 10 to a prime mover, which is not shown. An outer wall 20 of primary chamber 12 has a plurality of primary injection ports 22 through which finely-ground coal, air, or both are admitted to primary chamber 12. As shown in FIG. 3, the angular spacing between adjacent injectors 22 is constant. Furthermore, the axis of each port 22 is tangential to circular primary combustion chamber 12 so that air is injected in the direction of arrow "A" to induce circular motion of the fuel-air mixture.

Secondary air injection ports 24 are located in an upper surface 21 of the primary chamber. As with the primary injection ports 22, the angular spacing between adjacent secondary air injection ports 24 is constant. The axis of each is slanted as shown in FIG. 3 so that secondary air is injected in the direction of arrow "B" to induce circular motion of the secondary air mass.

The bottom of primary chamber 12 is open to secondary combustion chamber 14. Secondary chamber 14 is formed by outer conical section 26 and inner conical section 28. Inner conical section 28 depends from exhaust trunk 16. Outer conical section 26 surrounds inner section 28; the diameter of outer section 26 increases at a rate which is greater than the rate at which the diameter of inner section 28 increases. Thus, the cross-sectional area of secondary chamber 14 steadily increases toward the bottom of combustor 10.

A hemispherical combustor base 30 is attached to the lower end of outer conical section 26. Base 30 separates the combustion region from atmosphere and also collects molten ash which is withdrawn through a drain 32.

Primary air is provided to injection ports 22 through manifold 34, which surrounds combustor 10 near the lower end of outer conical section 26. The air passes from manifold 34 through a plurality of holes 36 into a space formed by outer conical section 26 and insulating jacket 38. The air travels upward around outer conical section 26, absorbing energy by heat transfer from secondary combustion chamber 14. Thus, the primary air is preheated, and the temperature in secondary combustion chamber 14 is moderated. Jacket 38 also surrounds primary combustion chamber 12, thus providing a plenum 39 through which the preheated air can travel to injection ports 22 and 24. Particulate coal is also delivered by any conventional means, not shown here, to alternate injection ports 22.

Exhaust trunk 16 also contains tertiary air injection ports 42. Unlike primary and secondary ports 22 and 24, however, these tertiary ports 42 are not tangential; instead, their axes point toward the central axis of combustor 10 so that air is injected in the direction of arrow "C" to reduce rotation of the hot gas.

The operation of combustor 10 will now be briefly described. Primary air, preheated by heat exchange with secondary combustion chamber 14, is distributed through plenum 39 to half of the primary injector ports 22. Fuel is mixed with primary air for injection into the other half of primary injection ports 22. Because ports 22 are tangential, the air-fuel mixture moves circularly within primary chamber 12 around exhaust trunk 16. The stoichiometric ratio is maintained at about 0.6, where 1.0 represents the amount of air just sufficient to completely combust a unit amount of a given type of coal. A ratio of 0.6 avoids formation of soot (occurring at lower ratios) and incompatible high temperatures (occurring at higher ratios). Preheated secondary air is introduced to the primay chamber via ports 24. Since these ports are slanted, this flow also contributes to the circular motion. Using multiple and tangential injector ports insures thorough and even mixing of the fuel and air. However, since the secondary air contains no fuel, the concentration of fuel is higher in the periphery of primary chamber 12 and lower toward the center of combustor 10, that is, nearer inner conical section 28 and exhaust trunk 16. Because of the circular flow in primary chamber 12, centrifugal force causes larger particles of fuel to remain near the periphery of chamber 12 for the longer period of time necessary for combustion. As the mass of the particles are reduced by combustion, the particles tend to move away from the periphery because centrifugal force is reduced, and because secondary air induces movement of the fuel-air mixture from primary chamber 12 to secondary chamber 14. The secondary air allows combustion to continue but also limits the maximum temperture, thus limiting the formation of nitrogen oxides.

Figure 2:
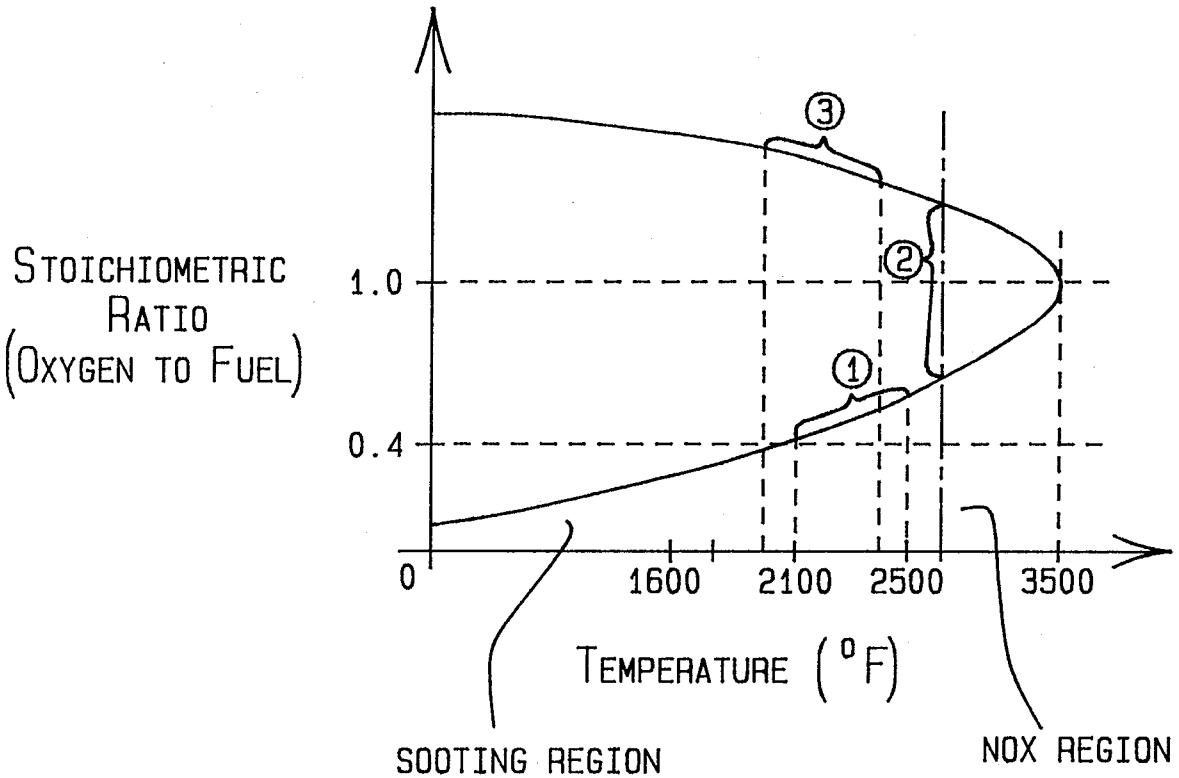
FIG. 2 is a graph depicting selected points in the combustion process.

The stoichiometric ratio of 0.6 is achieved by adjusting the relative quantities of fuel and air; FIG. 2 shows in range 1 the stoichiometric ratio and tempertures maintained in primary chamber 12. Thus, the formation of soot and nitrogen oxides are avoided. The even mixture of fuel and air also assures that the stoichiometric ratio is maintained within limits on a local as well as an overall basis.

Figure 4:
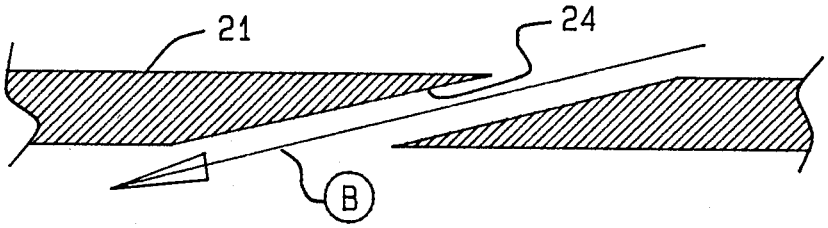
FIG. 4 is a detail view of one primary combustion chamber secondary air injection port.

The injection of secondary air allows combustion to continue. Because secondary air is, as shown in FIGS. 3 and 4, introduced in very nearly the same direction as the fuel-air mixture is already flowing, the circular flow is enhanced. Secondary air injection also provides a component of motion toward secondary chamber 14.

As the fuel-air mixture continues into secondary combustion chamber 14, combustion and the circular movement of the mixture continues. However, the temperature in secondary chamber 14 tends to decrease for two reasons. First, the gas in secondary chamber 14 is cooled by the upward flow of air between conical section 26 and jacket 38. Second, the volume of chamber 14 steadily increases in the downward direction; secondary air mixing with hot primary combustion products in this expansion region tends to limit the maximum temperature. Thus, excessive temperatures which can enhance the formation of pollutants, or harm the components of the prime mover are avoided. Range 2 in FIG. 2 represents the approximate conditions in the inner region of primary chamber 12 and upper region of secondary chamber 14. The relative amounts of primary and secondary air are adjusted to allow combustion to continue and to prevent formation of nitrogen oxides. Ash is carried by centrifugal force to the inner surface of outer conical section 26, and flows downward to drain 32. Finally, as the hot gas leaves secondary chamber 14, it must turn sharply to pass through inner conical section 28 and exhaust trunk 16; the sharply curving path tends to throw any remaining particulate material into base 30. Range 3 in FIG. 2 represents the conditions in the secondary combustion chamber. Tertiary air may be injected through ports 42 to deswirl the hot gas before it enters the prime mover.

The embodiments of this invention in which an exclusive property or privilege is claimed are defined as follows:

1. A combustor for particulate coal comprising:

an inner cone open at its upper and lower ends for the passage of combustion gas through the inner cone in an upward direction;

an outer cone separated from and surrounding the inner cone, the distance between the inner and outer cones being greater at their lower ends than at their upper ends, the annular space between the cones forming a chamber in communication with the passage through the inner cone;

a base attached to a lower end of the outer cone, separating the annular chamber and gas passageway from atmosphere;

a torus at to the upper end of the outer cone, the torus formed by an upper and an outer wall cooperating with the inner cone to form an enclosed space in communication with the annular chamber;

a plurality of ports in the outer wall of the torus for injection of a mixture of particulate coal and combustion air into the torus tangentially to its outer wall and in a circular direction around the inner cone; and a second plurality of ports in the upper wall of the torus for injection of additional combustion air in a circular direction around the inner cone.

2. A combustor for particulate coal comprising:

a primary combustion area contained within a toroidal ring;

a plurality of ports in the circumference of the toroidal ring for tangential injection of a coal and air mixture into the primary combustion area;

a second plurality of ports in an upper surface of the toroidal ring for tangential injection of air into the primary combustion area;

a secondary combustion area in communication with the primary combustion area through an opening in the bottom of the toroidal ring, the secondary combustion area being an annulus bounded by an inner conical section depending from the toroidal ring and an outer conical section surrounding the inner conical section and depending from the toroidal ring, the cross-sectional area of the annulus increasing in a direction away from the primary combustion area;

a base attached to the lower end of the outer conical section and including a drain for the removal of molten ash; and a chamber contained within the inner conical section having an inlet for receiving combustion gas from the secondary combustion area and an outlet for delivering the gas to a prime mover.

3. A coal combustor comprising:

a toroidal primary combustion chamber;

means for injecting air and particulate coal into the primary combustion chamber to establish combustion and a circular flow of combustion gas along a toroidal axis of the primary combustion chamber;

an annular secondary combustion chamber depending from and in communication from the primary combustion chamber;

means for injecting air into the secondary combustion chamber to continue combustion, continue the circular flow, cool the secondary combustion chamber, and cause a flow of combustion gas in the secondary combustion chamber in a direction away from the primary combustion chamber;

means for removing molten ash from the secondary combustion chamber;

a teritary chamber surrounded by the secondary combustion chamber and having a lower opening in communication with the secondary combustion chamber and a second opening in communication with a prime mover for conduction of the combustion gas from the secondary combustion chamber to the prime mover; and means for injecting air into the tertiary area to cool the gas to the maximum inlet temperature of the prime mover, and to eliminate circular movement of the gas.

* * * * *